US007142685B2

(12) United States Patent
Barnes

(10) Patent No.: US 7,142,685 B2
(45) Date of Patent: Nov. 28, 2006

(54) ADJUSTABLE LOUDSPEAKER

(75) Inventor: Dennis Hugh Barnes, Mesa, AZ (US)

(73) Assignee: DEI Headquarters, Inc., Vista, CA (US)

( * ) Notice: Subject to any disclaimer, the term of this patent is extended or adjusted under 35 U.S.C. 154(b) by 509 days.

(21) Appl. No.: 10/649,133

(22) Filed: Aug. 27, 2003

(65) Prior Publication Data

US 2005/0047626 A1 Mar. 3, 2005

(51) Int. Cl.
*H04R 25/00* (2006.01)

(52) U.S. Cl. ..... 381/396; 381/412; 381/414

(58) Field of Classification Search ..... 381/396–397, 381/400, 404, 412, 414, 420, 433
See application file for complete search history.

(56) References Cited

U.S. PATENT DOCUMENTS 5,173,943 A 12/1992 Dzurko
5,748,753 A 5/1998 Carver
5,940,522 A * 8/1999 Cahill et al. ..... 381/396
6,219,431 B1 * 4/2001 Proni ..... 381/412

OTHER PUBLICATIONS

Lampton, Theory of Bounded-Ripple Loudspkr Sys, IEEE Trans Audio & Electroacous AU20 #5 392-96 Dec. 1972.
Burrow & Grant, Efficiency of Low Power Aud Amp & Loudspkrs, IEEE Tran Consumer Elec., V47 #3 Aug. 2001.
Infinity Kappa Series 10VQ/10d VQ 2 12 VQ/12d VQ subwoofer instructions.

* cited by examiner

*Primary Examiner*—Suhan Ni
(74) *Attorney, Agent, or Firm*—Ryan J. Friedl, Esq.; Anatoly S. Weiser, Esq.; K C Bean, Esq.

(57) ABSTRACT

A loudspeaker motor structure uses variable geometry to change the effective magnetic field acting on the voice coil of the motor structure. A magnet generates the magnetic field, which couples into a front plate, a back plate, and a pole piece. In one loudspeaker, the front plate and the pole piece have notches and slots. Rotating the pole piece relative to the front plate varies the width of the gap between the pole piece and the front plate, and the effective magnetic field in the gap. In another loudspeaker, the pole piece moves up and down in relation to the back plate. This movement varies the magnetic coupling between the pole piece and the back plate and, consequently, the effective magnetic field in the gap between the pole piece and the front plate. Variations in the effective magnetic field in the gap result in variations of the loudspeaker parameters.

28 Claims, 13 Drawing Sheets

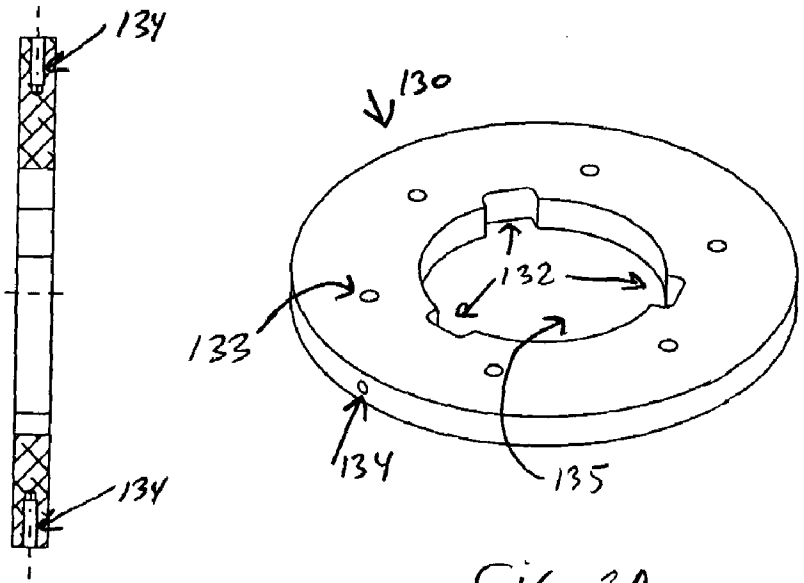
FIG. 3A
FIG. 3C
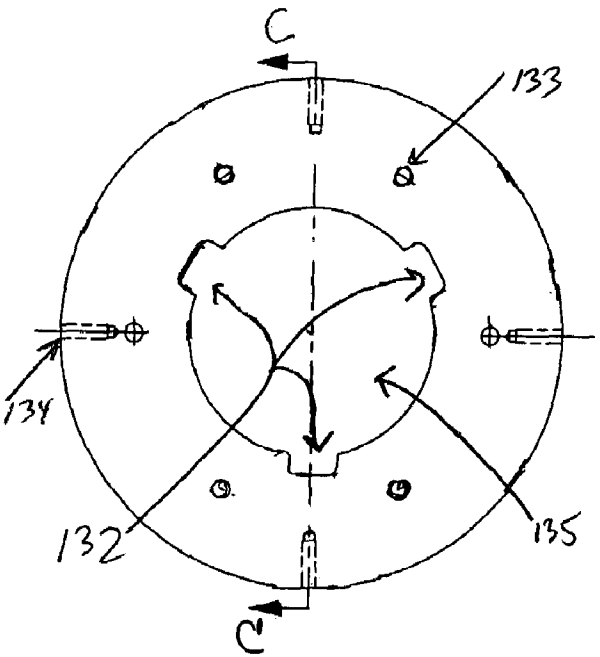
FIG. 3B

SECTION A-A

ADJUSTABLE LOUDSPEAKER

FIELD OF THE INVENTION

The present invention relates generally to the field of audio reproduction, and, more particularly, to loudspeakers and subwoofers.

BACKGROUND

A loudspeaker is a device that changes electrical signals into audible sounds. Its design is an important determinant of overall performance of an audio reproduction system. In choosing a particular loudspeaker design, engineers balance many competing considerations. Such considerations include frequency range of the loudspeaker, in-band amplitude and phase distortions, efficiency, and the so-called "Q" factor. The following paragraphs briefly discuss these considerations.

The frequency range of the loudspeaker should cover at least some portion of the audible frequency band, which extends from about 20 Hz to about 20 KHz. Generally, the wider the frequency range of the loudspeaker within the audible frequency band, the better. Because of the difficulty of designing high-quality speakers covering broad frequency ranges, some systems employ dedicated loudspeakers for reproduction of the low-end frequencies, in addition to other loudspeakers used for reproduction of mid-range and higher frequencies. The dedicated low-end loudspeakers, often referred to as woofers or subwoofers, typically cover the frequency range of between about 20 Hz and about 120 Hz.

Distortion means unwanted alteration of a waveform. Therefore, both phase distortion and amplitude distortion (also known as ripple), should be minimized to reproduce the original sound more authentically.

Efficiency is the ratio of the acoustic energy generated and radiated by the loudspeaker to the total electric energy delivered to the loudspeaker. Maximizing loudspeaker efficiency is important for several reasons. First, the higher is the efficiency, the lower is the required output power rating of the amplifier (or another source) driving the loudspeaker. Second, the power that is not radiated is converted into heat, which has to be removed from the loudspeaker, lest the loudspeaker overheat. And, of course, the consumption of the electric power by itself can be an important design factor, particularly for portable audio systems.

The Q factor is the ratio of the reactance and resistance of the electrical circuit model of the loudspeaker. Many loudspeakers operate with the Q factor in the range from about 0.2 to about 1.2. Musical speakers typically have the Q factor of about 0.6–0.7, while more accurate or "tight" speakers have the Q factor approaching 1.0–1.1. The Q factor range of about 0.2 to about 1.2 is rather subjective, but generally provides a relatively flat response curve. In contrast, other loudspeakers operate with higher Q factors. Their efficiencies are lower and their sound is typically more "booming" and distorted.

A typical dynamic loudspeaker includes an electrodynamic motor and a diaphragm, also known as a cone. The motor of the loudspeaker includes wire or voice coil windings on a former. The coil windings and the former slide along a cylindrical pole piece in a magnetic field generated by a permanent magnet. The former is mechanically coupled to the diaphragm. When an electrical current flows through the voice coil, the coil moves under influence of the Lorentz electromotive force exerted by the magnetic field of the permanent magnet on the charged particles flowing in the windings of the voice coil. The diaphragm moves together with the coil, creating variable acoustic pressure that reproduces the sound represented by the current.

The efficiency of the dynamic loudspeaker with a moving voice coil is low for at least two reasons. First, the movement of the diaphragm "pushes out" the air on one side (e.g., the front), while "pulling in" the air on the opposite side (e.g., the back). The two movements tend to cancel each other, unless the loudspeaker is placed within an enclosure. When the loudspeaker is placed in an enclosure, the movement of the diaphragm increases and decreases the volume within the enclosure, corresponding to the movement of the diaphragm out and into the enclosure, respectively. The changes in the volume of the enclosure generate changes in the air pressure within the enclosure, which must be counteracted by the diaphragm. This condition exists in both sealed and vented enclosures, and creates an additional load on the diaphragm and on the motor. The additional load consumes energy and lowers the efficiency of the loudspeaker.

Second, air density is low. Therefore, the voice coil needs to drive a large diaphragm surface at a high velocity to radiate significant acoustical pressures. The structural integrity required by a large, fast moving diaphragm necessitates a sturdy construction of the diaphragm and its supporting structure. The combined mass of the diaphragm and the supporting structure is large in comparison to the mass of the air moved. Essentially, a heavy diaphragm must be moved to push a small mass of air. In technical terms, the acoustic impedance of the diaphragm is much higher than the impedance presented by the moving air.

For a fixed loudspeaker enclosure volume, efficiency increases with the increase in the low corner cutoff frequency ($f_c$) of the loudspeaker. This relationship is known as Hoffman's Iron Law. Stating this law differently, for a given volume of the enclosure, increasing efficiency will generally increase the low corner cutoff frequency $f_c$ of the loudspeaker, diminishing the loudspeaker's low frequency response.

Increasing loudspeaker efficiency also decreases the Q factor of the loudspeaker. Recall that a decrease in the Q factor may make the loudspeaker less accurate.

An increase in loudspeaker efficiency can thus entail a performance penalty, particularly when it is achieved without a corresponding increase in the volume of the loudspeaker's enclosure. Moreover, efficiency is not the end all and be all of the loudspeaker design; high efficiency may not even be needed in some applications. For example, an amplifier driving the loudspeaker may have the capacity to drive a low-efficiency loudspeaker with a signal sufficient to reproduce sound with the required volume, and the installed environment of the loudspeaker may provide abundant ventilation for cooling. In this case, loudspeaker efficiency can be sacrificed to obtain a better low frequency response and more authentic sound reproduction capability of the audio system. Conversely, performance may have to be sacrificed for the sake of efficiency where a predetermined sound level has to be obtained from a relatively weak amplifier/driver, especially in a small enclosure. It follows that a loudspeaker with fixed design parameters—including efficiency—may not be the optimum device for a particular system. In fact, such a loudspeaker may not even provide the minimum acceptable performance level required by the system.

Sound preferences are no less subjective than beauty which, according to a well-known expression, resides in the eye of the beholder. Some listeners prefer "tight" loudspeakers, while others favor musical loudspeakers. The ability to tune the sound of an audio system, beyond simple treble, bass, and other equalizer adjustments, would be a valuable feature of a loudspeaker.

Vendors of loudspeakers, and particularly of subwoofers, often require custom-made enclosures to match the parameters of the loudspeaker motor structure. (A motor structure may include a voice coil, magnet, diaphragm, and related components.) It would be desirable to be able to match the motor structure of a loudspeaker to a range of enclosures, rather than limiting the motor structure to a custom-made enclosure.

A need thus exists for a loudspeaker that can be adapted to various installed environments. A further need exists for a loudspeaker that can be customized for installations within enclosures of various sizes. A still further need exists for a loudspeaker with adjustable sound reproduction characteristics.

SUMMARY

The present invention is directed to apparatus that satisfies these needs. The apparatus disclosed is a loudspeaker with a basket, a spider attached to the basket, a movable diaphragm, a pole piece, a magnet, a front plate, and upper and lower back plates. The pole piece has a top end with cylindrical walls elongated along a center line axis of the pole piece. The cylindrical walls have at least one irregularity, i.e., a slot or a protrusion. The pole piece also has a base with a base diameter larger than diameter of the top end.

The magnet has an annular shape with first and second relatively flat magnet surfaces normal to the center line axis. A magnet opening extends along the axis in the middle of the magnet.

The front plate has first and second front plate surfaces normal to the axis, and a front plate opening extending along the axis between the first and second front plate surfaces. At least one front plate irregularity exists on the walls of the opening. The second front plate surface is attached to the first magnet surface. The front plate is also attached to the basket.

The upper back plate has first and second upper back plate surfaces normal to the axis, and an upper back plate opening extending along the axis between the first and second upper back plate surfaces. This opening is divided into (1) a first space with a first dimension (near the first upper back plate surface), and (2) a second space with a second dimension (near the second upper back plate surface). The second dimension and the base diameter are each larger than the first dimension. The first surface of the upper back plate is attached to the second surface of the magnet.

The lower back plate is attached to the second upper back plate surface, creating a partially enclosed chamber in the second space of the upper back plate. The base of the pole piece is positioned in this chamber, while the top end of the pole piece is positioned in the front plate opening, forming a gap between the top end and the front plate. A magnetic field extends through this gap.

The voice coil includes a former and wire windings capable of receiving an electrical driving current. It is positioned on the top end of the pole piece, in the magnetic field of the gap. The voice coil's former is attached to both the spider and the diaphragm, and drives the diaphragm when the voice coil slides along the top end under influence of an electromotive force resulting from interaction of the magnetic field in the gap and the driving current. Movements of the diaphragm create acoustic pressure changes, i.e., sounds generated by the loudspeaker.

The lower and upper back plates are capable of both loose and tight attachment to each other. When these components are loosely attached, the base of the pole piece can be rotated around the axis relative to the front plate. Such rotation changes the spacial relationship of the irregularities of the pole piece and the front plate, and, consequently, the strength of the magnetic field in the gap. Therefore, the rotation changes the parameters of the loudspeaker. When the lower and upper back plates are tightly attached, the pole piece is fixed in place and prevented from rotating under expected operational and environmental conditions of the loudspeaker.

Another loudspeaker in accordance with the present invention includes a basket, a diaphragm, a spider attached to the basket, an annular magnet, a magnetic pole piece, front and back plates, a non-magnetic center thread piece, and a voice coil.

The pole piece has a cylindrical top end elongated along a center line axis, and a bottom end with an aperture extending along the axis.

The magnet is annular in shape, with first and second relatively flat surfaces normal to the axis.

The magnetic front plate, attached to the frame, includes a first and second front plate surfaces normal to the axis, and a front plate opening extending along the center line axis between the first and second front plate surfaces. The second front plate surface is attached to the first magnet surface.

The magnetic back plate includes a first and second back plate surfaces normal to the axis, and a back plate opening extending along the axis between the first and second back plate surfaces. The back plate opening is divided into a first space with a first dimension, e.g., a diameter of a circle, and a second space with a second diameter. The first space is nearer the first back plate surface than the second back plate surface, while the second space is nearer the second back plate surface than the first back plate surface. The walls of the second space are threaded.

The non-magnetic center thread component has an inner part positioned in the aperture of the pole piece, and a jutting part protruding from the aperture. The jutting part has a thread matching the thread on the walls of the second space, and is threaded into the second space. The top end of the pole piece, which is attached to and supported by the inner part of the center thread component, is positioned in the front plate opening, forming a first gap between itself and the front plate.

The voice coil has a former and wire windings capable of receiving electrical driving current. The coil is attached to the spider and to the diaphragm, sliding on the top end of the pole piece, in the first gap. An electromotive force generated by interaction of the driving current and the magnetic field in the first gap causes the coil to slide on the top end. The diaphragm moves with the coil, creating acoustic pressure changes.

When the center thread component is rotated within the back plate, the engaged threads on the jutting part and on the walls of the second space cause the center thread component to move along the center line axis. The pole piece moves together with the center thread component, thereby varying the width of a second gap between the pole piece and the back plate. Magnetic coupling between the pole piece and the back plate also varies with variations in the width of the second gap. The magnetic field in the first gap varies, too: the strength of the magnetic field increases when the pole piece is turned in a first direction to bring the pole piece towards the back plate, and decreases when the pole piece is turned in a second direction to take the pole piece away from the back plate. Because the loudspeaker's parameters depend on the strength of the magnetic field in the first gap, the parameters can be adjusted by rotating the center thread component and changing the width of the second gap.

BRIEF DESCRIPTION OF THE FIGURES

These and other features and aspects of the present invention will be better understood with reference to the following description, appended claims, and accompanying drawings, wherein:

FIG. 3A illustrates a perspective view of the top plate of the loudspeaker motor structure of FIG. 1;

FIG. 3B illustrates a top view of the top plate of the loudspeaker motor structure of FIG. 1;

FIG. 3C illustrates a cross-sectional view of the top plate of the loudspeaker motor structure of FIG. 1, with the cross-section taken along the line C—C';

DETAILED DESCRIPTION

Figure 1:
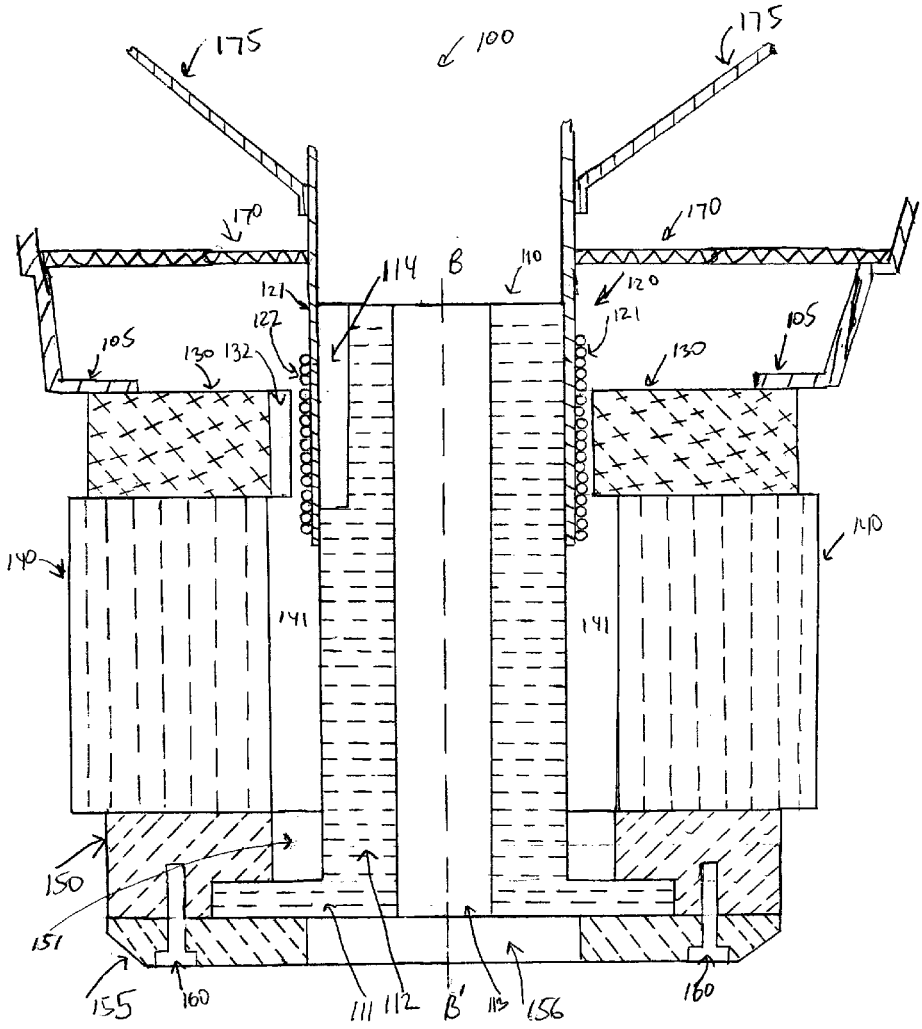
FIG. 1 illustrates a cross-sectional view of a loudspeaker motor structure in accordance with the present invention.

Reference will now be made in detail to several embodiments of the invention that are illustrated in the accompanying drawings. Wherever possible, same or similar reference numerals are used in the drawings and the description to refer to same or like parts. The drawings are in simplified form and are not to precise scale. For purposes of convenience and clarity only, directional terms, such as, top, bottom, left, right, up, down, over, above, below, beneath, rear, back, front, horizontal, and vertical may be used with respect to the accompanying drawings. These and similar directional terms should not be construed to limit the scope of the invention in any manner. In addition, certain words, for example, cone and diaphragm, are used interchangeably. No significance should be attached to the use of similar words, rather than the same word, unless the difference between the words is noted or made otherwise clear from the context.

As mentioned in the background section, loudspeaker efficiency ($E_{ff}$) is the ratio of the radiated acoustic energy to the electric energy delivered to the loudspeaker. If efficiency is very low—which is the usual case for loudspeakers—the total electric power ($P_e$) dissipated in the loudspeaker is approximated by the ohmic losses in the voice coil: $P_c=R_c\times i^2$, where i is the current through the voice coil and $R_c$ is the resistance of the voice coil. The acoustic power ($P_a$) radiated by the loudspeaker is roughly proportional to the square of the ($B\times l\times i$) product: $P_a=K_{ap}\times(B\times l\times i)^2$, where B is the flux density of the magnetic field through which the voice coil travels; l is the length of the wire of the voice coil; and $K_{ap}$ is the acoustic power proportionality constant, reflecting such factors as the moving mass, air density, volume of the enclosure, and area of the diaphragm. The efficiency is thus roughly proportional to the square of the magnetic field flux density B.

In accordance with the present invention, a loudspeaker's efficiency $E_{ff}$, Q factor, low corner frequency cutoff $f_c$, and other parameters are adjusted by varying the magnetic field flux density (magnetic field strength) B in the gap where the voice coil of the loudspeaker moves.

Figure 4B:
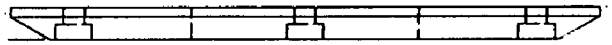
FIG. 4B illustrates a side view of the lower back plate portion of the loudspeaker motor structure of FIG. 1.
Figure 4A:
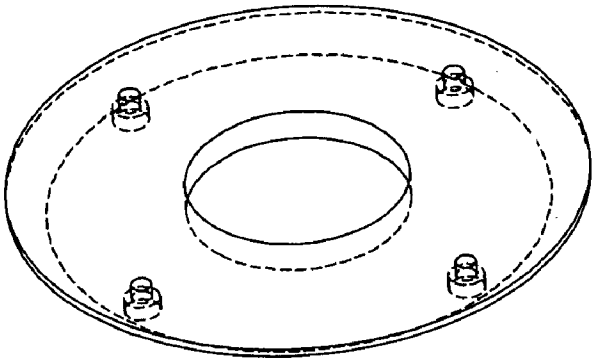
FIG. 4A illustrates a perspective view of the lower back plate portion of the loudspeaker motor structure of FIG. 1.

Referring more particularly to the drawings, FIG. 1 is a cross-sectional view of a loudspeaker motor structure 100 in accordance with the present invention. In the figure, a permanent annular magnet 140 has a circular opening 141 in its center for positioning a pole piece 110 and a voice coil 120, which slides on the pole piece 110. The magnet 140 is disposed between an upper back plate portion 150, illustrated in FIGS. 2A–2C, and a front plate 130, illustrated in FIGS. 3A–3C. A lower back plate portion 155, illustrated in FIGS. 4A and 4B, is disposed under the upper back plate portion 150. The magnet 140 is attached to the plates 130 and 150 using glue, while bolts 160 attach the lower back plate portion 155 to the upper back plate portion 150. In alternative embodiments, other suitable attachment methods are used to hold these components together. For example, in some embodiments bolts pass through the magnet 140 and the plates 130, 150 and 155, holding these four components together. In other embodiments, the upper back plate portion 150 and the lower back plate portion 155 are glued together using cement, forgoing the use of the bolts 160.

In the loudspeaker motor structure 100, the magnet 140 is made of iron. Alternative compositions for the magnet 140 include, for example, nickel, cobalt, and various alloys of iron, nickel, and cobalt.

Figure 5C:
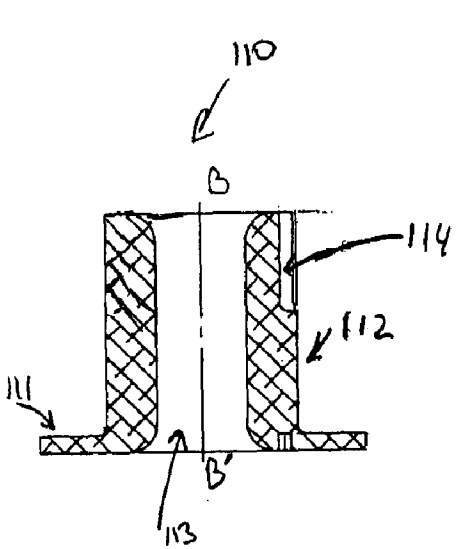
FIG. 5C illustrates a cross-sectional view of the pole piece of the loudspeaker motor structure of FIG. 1, with the cross-section taken along the line D—D'.
Figure 5B:
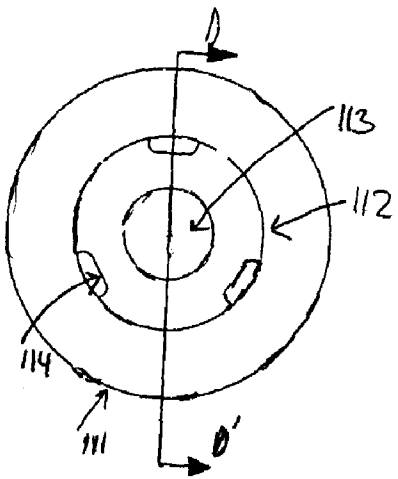
FIG. 5B illustrates a top view of the pole piece of the loudspeaker motor structure of FIG. 1.
Figure 5A:
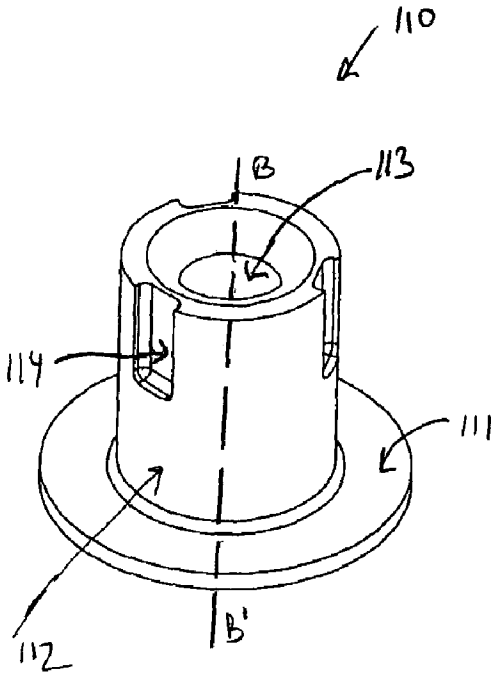
FIG. 5A illustrates a perspective view of the pole piece of the loudspeaker motor structure of FIG. 1.

FIGS. 5A–5C illustrate the pole piece 110. The pole piece 110 includes a base 111 and an elongated cylindrical part 112. A center bore 113 allows air to pass through the pole piece 110 and to cool it and the rest of the motor structure 100. The center bore 113 flares at each end to reduce friction with the air and the resulting noise. Three vertical slots 114 are evenly arranged on the circumference of the upper segment of the cylindrical part 112. The function of the slots 114, whose number varies in different modifications, will be discussed at a later point.

Figure 2A:
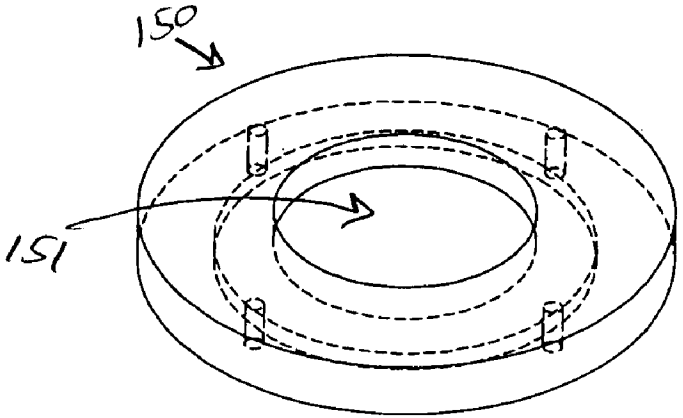
FIG. 2A illustrates a perspective view of the upper back plate portion of the loudspeaker motor structure of FIG. 1.
Figure 2C:
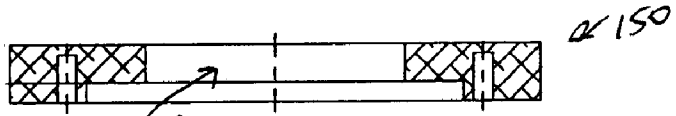
FIG. 2C illustrates a cross-sectional view of the upper back plate portion of the loudspeaker motor structure of FIG. 1, with the cross-section taken along the line A—A'.
Figure 2B:
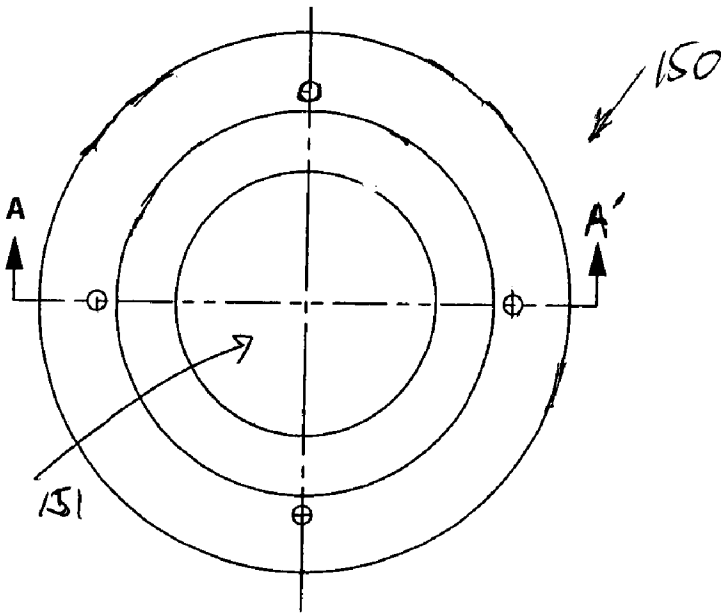
FIG. 2B illustrates a bottom view of the upper back plate portion of the loudspeaker motor structure of FIG. 1.

Referring now to FIGS. 2A, 2B, and 2C, the upper back plate portion 150 is round with a circular opening 151 in its center. The opening 151 has two diameters: a smaller diameter at the top, and a larger diameter at the bottom. After the back plate portions 150 and 155 are assembled together as shown in FIG. 1, the larger diameter opening forms a partially enclosed chamber above the top surface of the lower back plate portion 155. The base 111 of the pole piece 110 fits snugly in this chamber when the upper portion 150 is tightly attached to the lower back plate portion 155. When the back plate portions 150 and 155 are loosely attached to each other, the base 111 is sufficiently free to allow the pole piece 110 to be rotated around its center line axis B—B' relative to the front plate 130. Here, the "tightly attached" condition means attachment that supplies sufficient pressure on the base 111 so that the pole piece would not rotate during normal operation and under normal ambient conditions of the motor structure 100; the "loosely attached" condition means attachment that allows the base 111 to be rotated for purposes of adjustment, without damaging the motor structure 100. Note that according to this definition, the plates can be attached loosely and tightly at the same time.

As illustrated in FIGS. 3A–3C, the front plate 130 includes vertical screw holes 133 and horizontal screw holes 134. These holes are used to attach the motor structure 100 to the basket (i.e., frame or chassis) of the loudspeaker. The front plate 130 further includes a center opening 135 for receiving the cylindrical part 112 of the pole piece 110. Three notches 132 are evenly spaced on the circumference of the center opening 132. The function of these notches 132, whose number varies in different modifications, will also be discussed at a later point, together with the function of the slots 114 of the pole piece 110.

The voice coil 120, including its former 121 and wire windings 122, slides up and down on the cylindrical part 112 of the pole piece 110. When the voice coil 120 is at rest, its position on the pole piece 110 is determined by a spider 170, which is attached to the basket of the loudspeaker, and by the diaphragm 175, which is attached to the basket by a surround. (The surround is not shown in the figures.) The spider 170 is made of a flexible material that can hold the voice coil 120 in place when the voice coil 120 is not driven by an electric current, and yet allows the coil 120 to move under influence of an electromotive force when the voice coil 120 is driven by an electric current. In the motor structure 100, the spider 170 is made of multi-layered fabric. Many other materials are used in place of the fabric in alternative embodiments.

In operation, the voice coil 120 moves in the gap between the pole piece 110 and the circumference of the opening in the plate 130. Because the pole piece 120 and the plates 130 and 150 are made of a magnetic (paramagnetic or ferromagnetic) material—steel in the motor structure 100— the magnetic flux emanated by the magnet 140 extends through this gap. Thus, the electric current flowing through the windings of the voice coil 120 creates the electromotive force that moves the coil. The former 121 of the voice coil 120 is attached to the diaphragm 175, so that the diaphragm 175 moves along with the voice coil 120, translating the movements of the voice coil 120 into acoustic pressure variations.

Figure 6A:
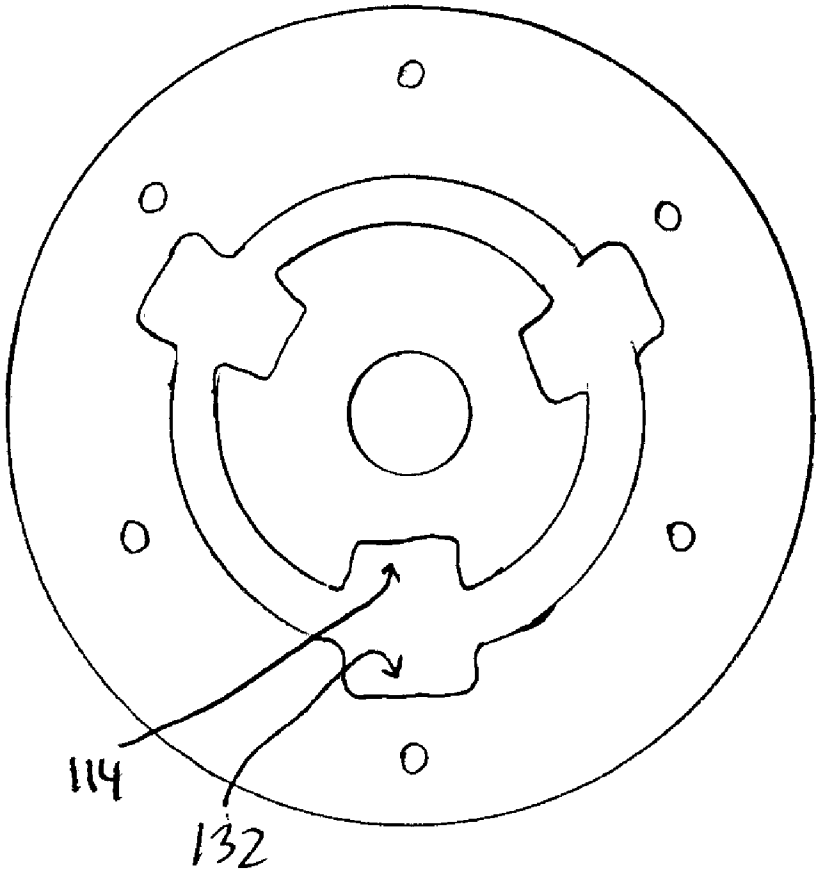
FIG. 6A illustrates a top view of the top plate and the pole piece of the motor structure of FIG. 1, with the pole piece and the top plate assembled together so that the notches on the top plate face the slots of the pole piece.
Figure 6B:
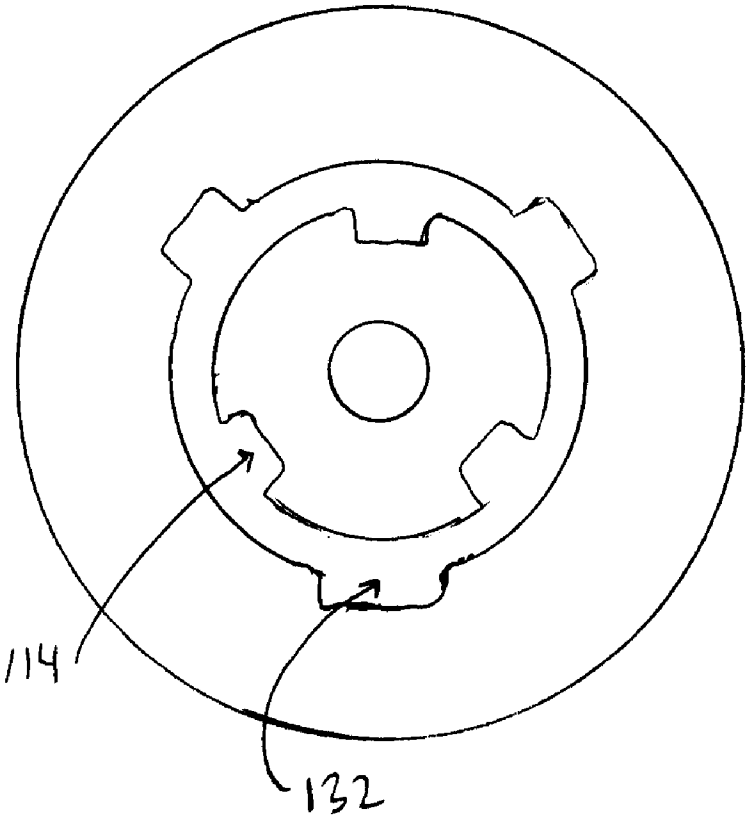
FIG. 6B illustrates a top view of the top plate and the pole piece of the motor structure of FIG. 1, with the pole piece and the top plate assembled together so that the notches on the top plate do not face the slots of the pole piece.

One of the major parameters determining the strength of the magnetic field in the gap between the front plate 130 and the cylindrical part 112 is the width of the gap, i.e., the distance between the front plate 130 and the cylindrical part 112. This distance depends on the relative positions of the notches 132 on the front plate 130 and the slots 114 on the pole piece 110. If the notches 132 and the slots 114 are disposed opposite one another, the gap is increased where the notches 132 face the slots 114. This is illustrated in FIG. 6A. The magnetic field strength is therefore decreased in those places. If the notches 132 do not face the slots 114, the maximum gap width is decreased, as is illustrated in FIG. 6B. In this case, the magnetic field strength is decreased in the space adjacent to the notches 132 and in the space adjacent to the slots 114, but to a disproportionately lesser degree than when the notches 132 face the slots 114. As a consequence, the effective magnetic field strength in the gap increases. Because the magnetic field strength is a non-linear function of the gap width, varying the relative angular positions of the cylindrical part 112 and the front plate 130 results in variation of the effective magnetic field acting on the voice coil 120.

Recall that when the back plate portions 150 and 155 are not held tightly together, the base 111 of the pole piece 110 can be rotated in the partially enclosed chamber above the top surface of the lower back plate portion 155. The pole piece 110 can therefore be rotated around its center line B-B' in relation to the combination of the lower back plate portion 155, the upper back plate portion 150, the annular magnet 140, and the front plate 130. As discussed above, the rotation of the pole piece 110 varies the effective magnetic field acting on the voice coil 120, and therefore causes the Q factor, the efficiency, and other parameters of the loudspeaker to vary with it. Thus, by rotating the pole piece 110, we can adjust the parameters of the motor structure 100 and of the loudspeaker where the motor structure 100 is installed.

In a modification of the motor structure 100, the front plate rotates around a stationary pole piece. For example, the front plate can be secured to the annular magnet using screws and a number of predrilled holes. To adjust the relative position of the front plate and the pole piece, the screws are removed, the front plate is rotated to a new position, and the screws are re-inserted to attach the front plate to the magnet in the new position. The pole piece in this modification can be integrated with the back plate.

In another modification of the motor structure 100, the notches and the slots are replaced with bulges on the front plate and protrusions on the pole piece. When the notches and the bulges face each other, the magnetic field in the gap increases; when the notches and the bulges do not face each other, the magnetic field decreases. Hereinafter, we will occasionally use "irregularity" to refer generically to a notch, slot, bulge, or protrusion.

In yet another modification of the motor structure 100, the front plate is a part of the magnet 140.

More generally, the magnetic structure of a loudspeaker takes many shapes in different modifications of the motor structure 100. (Magnetic structure means at least one magnetic component that positions one magnetic pole across a gap from a top end of the pole piece, and that magnetically couples one bottom end of the pole piece to the opposite magnetic pole, with the voice coil of the loudspeaker being located in the gap.)

Figure 7A:
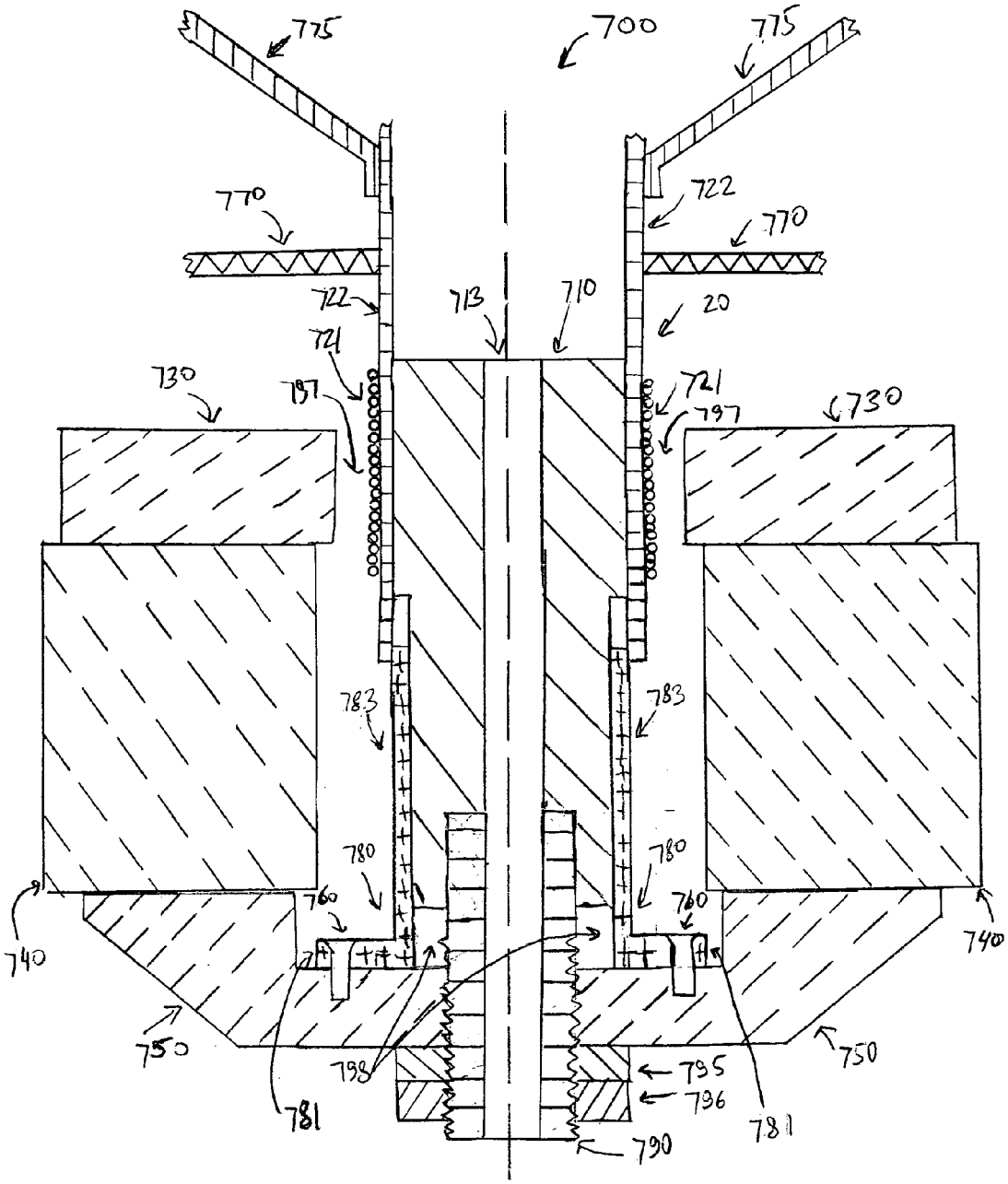
FIG. 7A illustrates a cross-sectional view of another loudspeaker motor structure in accordance with the present invention.
Figure 7B:
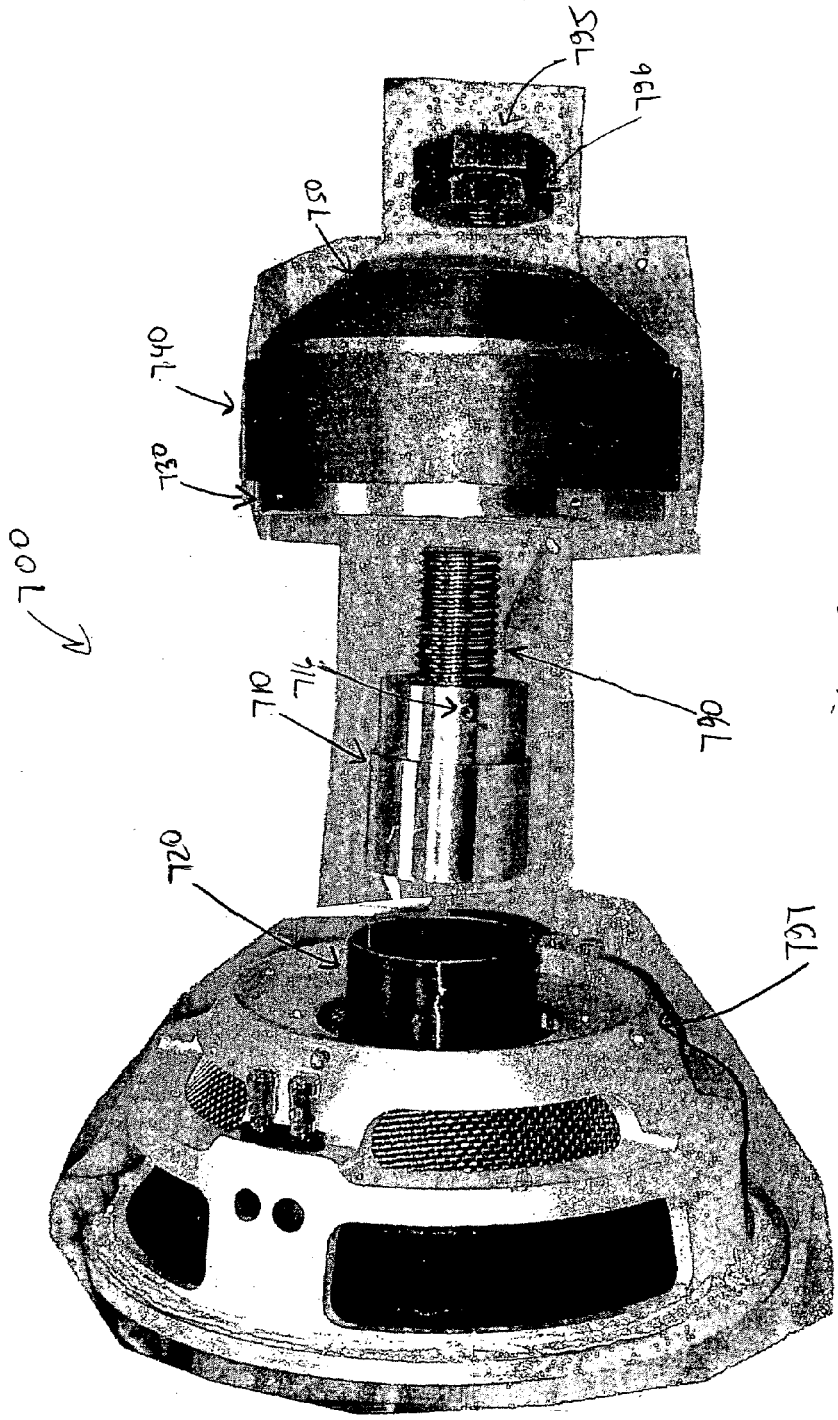
FIG. 7B illustrates a partial exploded perspective view of the loudspeaker motor structure of FIG. 7A.
Figure 8A:
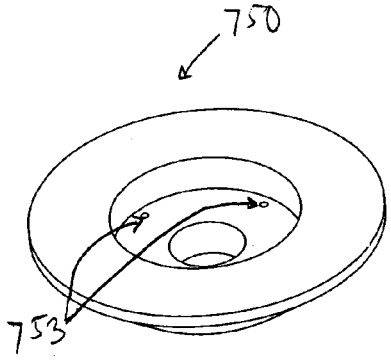
FIG. 8A illustrates a perspective view of the back plate of the loudspeaker motor structure of FIG. 7A.
Figure 8B:
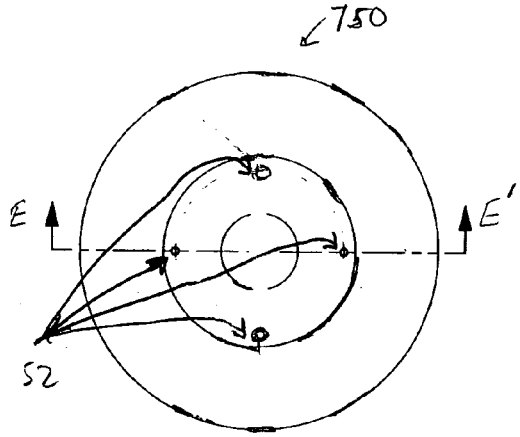
FIG. 8B illustrates a top view of the back plate of the loudspeaker motor structure of FIG. 7A.
Figure 8C:
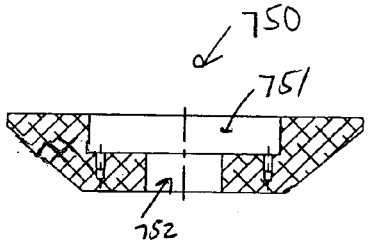
FIG. 8C illustrates a cross-sectional view of the back plate of the loudspeaker motor structure of FIG. 7A, with the cross-section taken along the line E—E'.
Figure 9A:
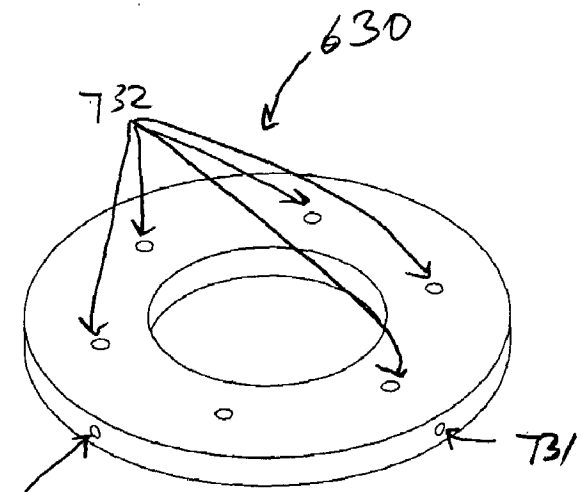
FIG. 9A illustrates a perspective view of the top plate of the loudspeaker motor structure of FIG. 7A.
Figure 9C:
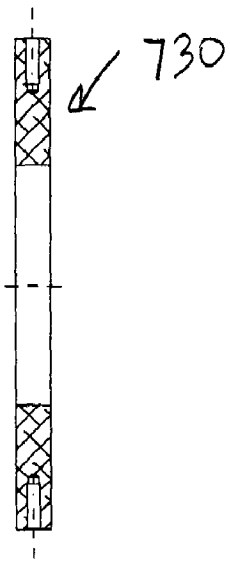
FIG. 9C illustrates a cross-sectional view of the top plate of the loudspeaker motor structure of FIG. 7A, with the cross-section taken along the line F—F'.
Figure 9B:
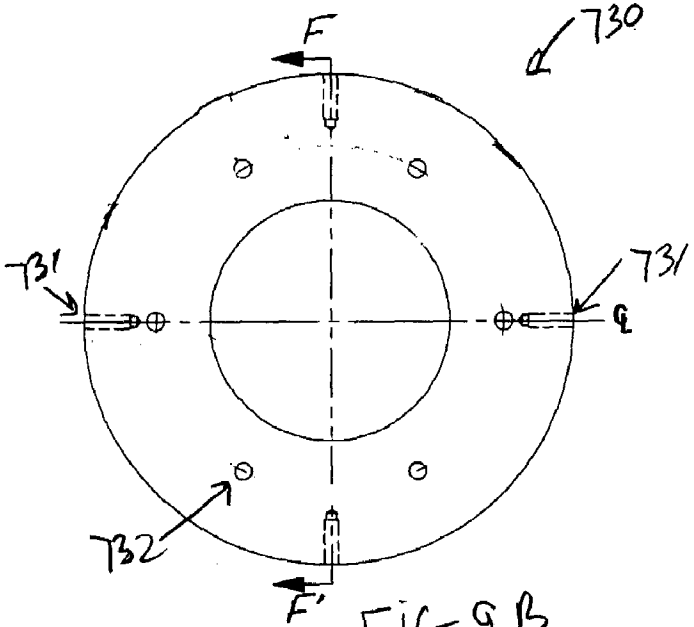
FIG. 9B illustrates a top view of the top plate of the loudspeaker motor structure of FIG. 7A.

FIGS. 7A and 7B illustrate, respectively, a cross-sectional view and a partial exploded perspective view of a loudspeaker motor structure 700 in accordance with the present invention. An annular magnet 740 is sandwiched between a back plate 750, which is illustrated in FIGS. 8A–8C, and a front plate 730, illustrated in FIGS. 9A–9C. These three components are glued together, but other attachment methods are used for this purpose in alternative embodiments. The magnet 740, the front plate 730, and the back plate 750 have central openings for positioning a pole piece 710, a voice coil 720, a heat-conducting sleeve 780, and a center thread component 790.

Figure 10A:
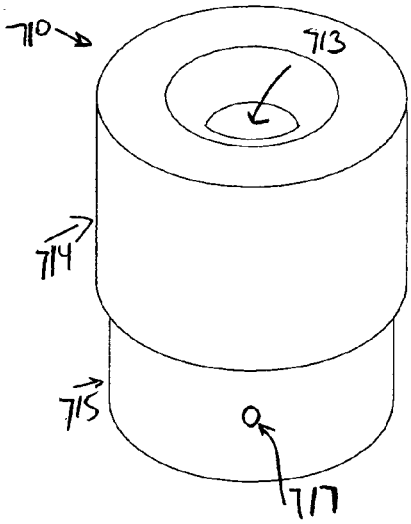
FIG. 10A illustrates a perspective view of the pole piece of the loudspeaker motor structure of FIG. 7A.
Figure 10B:
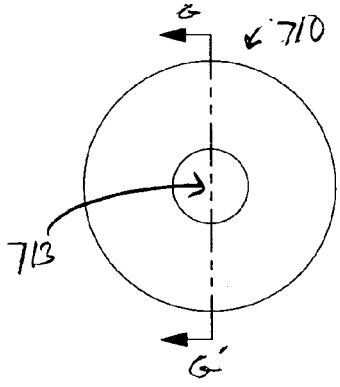
FIG. 10B illustrates a top view of the pole piece of the loudspeaker motor structure of FIG. 7A.
Figure 10C:
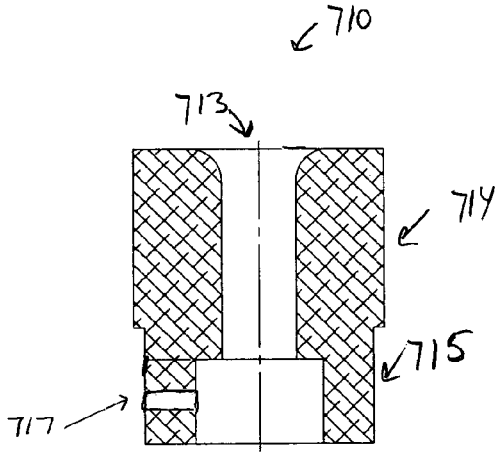
FIG. 10C illustrates a cross-sectional view of the pole piece of the loudspeaker motor structure of FIG. 7A, with the cross-section taken along the line G—G'.

As illustrated in FIGS. 10A–10C, the pole piece 710 is a substantially cylindrical part with a bore 713 in its center. The diameter of the pole piece 710 is slightly smaller at its lower portion 715 than in its upper portion 714, while the diameter of the center bore 713 is larger at its lower section than at the top. The lower, wider section of the center bore 713 receives and attaches to the upper portion of the center thread component 790. The center thread component 790 is a rod, smooth on one end and threaded on its second end. In the motor structure 700, the smooth end of the center thread component 790 is pressed into the center bore 713 and secured there by a screw 716 in a hole 717, which is transverse to the center bore 713. The threaded end of the center thread component 790 protrudes from the pole piece 710.

The center opening of the back plate 750 is divided into a larger aperture 751 at its upper end, and a smaller aperture 752 at its lower end. Walls of the smaller aperture are threaded to match the tread on the protruding portion of the center thread component 790. As shown, the center thread component 790 is threaded into and through the back plate 750, and secured by two locknuts 795 and 796 adjacent to the lower surface of the back plate 750.

Figure 11A:
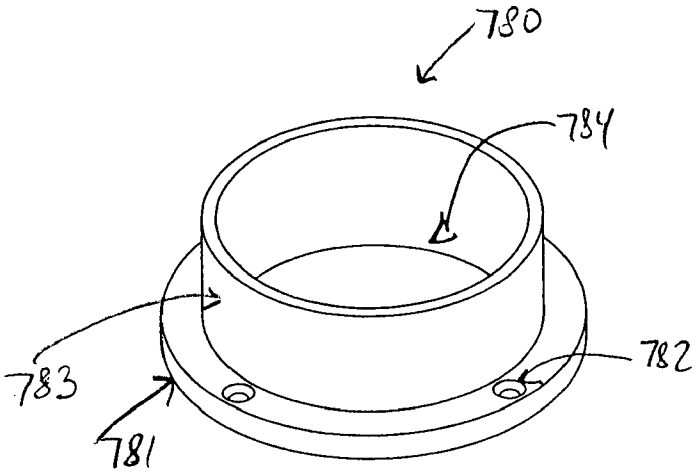
FIG. 11A illustrates a perspective view of the heat-conducting sleeve of the loudspeaker motor structure of FIG. 7A.
Figure 11B:
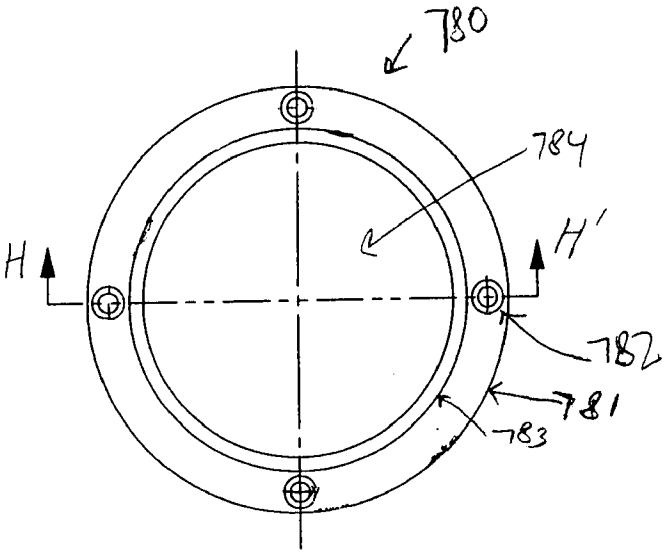
FIG. 11B illustrates a top view of the heat-conducting sleeve of the loudspeaker motor structure of FIG. 7A.
Figure 11C:
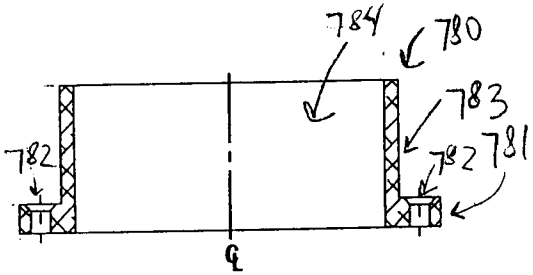
FIG. 11C illustrates a cross-sectional view of the heat-conducting sleeve of the loudspeaker motor structure of FIG. 7A, with the cross-section taken along the line H—H'.

FIGS. 11A through 11C illustrate the sleeve 780, which has a base 781, through holes 782, and a side wall 783 surrounding a center opening 784. The inner diameter of the center opening 784 is such that the side wall 783 is in contact, or nearly in contact, with the lower portion 715 of the pole piece 710 when the pole piece 710 is positioned in the center opening 784, as shown in FIG. 7A. The sleeve 780 is attached to the back plate 750 using screws 760 and the through holes 782. In this way, the sleeve 780 facilitates heat transfer between the pole piece 710 and the back plate 750. In the motor structure 700, the sleeve 780 is made of aluminum. Alternative motor structure embodiments use other heat-conducting, non-ferromagnetic and non-paramagnetic materials, such as copper and bronze.

A voice coil 720 includes wire windings 721 and a coil former 722. The voice coil 720 slides on the upper portion 714 of the pole piece 710 and, possibly, on the side wall 783 of the sleeve 780. This movement occurs within the magnetic field in the gap 797, between the pole piece 710 and the front plate 730. A spider 770 and a diaphragm 775 locate the voice coil 720 when the voice coil is not subjected to the electromotive force generated by the interaction of the magnetic field in the gap 797 and a current flowing through the windings 721.

Note that when the locknuts 795 and 796 are loosened, the center thread component 790 can rotate within the aperture 752 of the back plate 750. Because the center thread component 790 and the walls of the aperture 752 are both threaded, and their threads are engaged with each other, rotating the center thread component 790 raises or lowers the center thread component 790 and the pole piece 710 attached to it. Raising and lowering the pole piece 710 varies the gap 798 between the pole piece 710 and the surface of the back plate 750.

The pole piece 710 and the plates 730 and 750 are made of steel. In alternative embodiments, these components are made of other ferromagnetic or paramagnetic materials. When the pole piece 710 is lowered to be in contact with the back plate 750, magnetic flux flows substantially unimpeded from the magnet 740 to the front plate 730 and the back plate 750, and from the back plate 750 to the pole piece 710. Magnetic field strength within the gap 797 (between the pole piece 710 and the front plate 730) is then maximized. Once the pole piece 710 is raised above the surface of the back plate 750, the magnetic flux must traverse the gap 798. The wider the gap 798, the more resistance it presents to the magnetic flux, and the smaller the magnitude of the magnetic field strength in the gap 797. Consequently, the parameters of the motor structure 700 can be adjusted by loosening the locknuts 795 and 796, rotating the center thread component 790 to obtain the desired parameters of the motor structure 700, and re-tightening the locknuts 795 and 796 to fix the center thread component 790 in the new position.

This document describes the inventive adjustable loudspeakers and some of their features in considerable detail for illustration purposes only. Neither the specific embodiments of the invention as a whole, nor those of its features limit the general principles underlying the invention. The invention is not limited to the particular component arrangements and methods for changing motor structure geometry, but includes all component arrangements and methods used to change the geometry of the motor structure in order to vary the magnetic field acting on the voice coil. A range of component attachment methods and utilizations of various magnetic and non-magnetic materials also fall within the intended scope of the invention. The specific features described herein may be used in some embodiments, but not in others, without departure from the spirit and scope of the invention as set forth. Indeed, some of the components employed in the described embodiments can be omitted altogether. Many additional modifications are intended in the foregoing disclosure, and it will be appreciated by those of ordinary skill in the art that, in some instances, certain features of the invention will be employed in the absence of a corresponding use of other features. The illustrative examples therefore do not define the metes and bounds of the invention and the legal protection afforded the invention, which function has been assigned to the claims and their equivalents.

I claim:

1. A loudspeaker motor structure comprising:

a magnetic pole piece comprising a first end elongated along an axis and a second end;

a magnetic structure comprising:

a magnet comprising a first magnetic pole and a second magnetic pole, the second magnetic pole being magnetically coupled to the second end of the pole piece, and portions defining an opening along the axis, the first end of the pole piece being positioned in the opening of the magnetic structure to form a gap between the first end of the pole piece and the portions defining the opening of the magnetic structure proximate to the first end of the pole piece, the portions defining the opening that are proximate the first end of the pole piece being magnetically coupled to the first magnetic pole, resulting in a magnetic field in the gap; and a voice coil sliding on the first end of the pole piece along the axis in the gap;

wherein:

the pole piece and the portions defining the opening of the magnetic structure proximate to the first end of the pole piece are capable of being rotated relative each other around the axis under predetermined conditions; and the magnetic field in the gap varies with rotation of the pole piece and the portions defining the opening of the magnetic structure proximate to the first end of the pole piece relative each other around the axis.

2. A loudspeaker motor structure according to claim 1, further comprising a diaphragm and a spider, wherein:

the voice coil comprises a former and wire windings capable of receiving driving current, the voice coil being subjected to an electromotive force generated by interaction of the driving current and the magnetic field in the gap;

the former of the voice coil is coupled to the spider; and the former of the voice coil is coupled to the diaphragm to move the diaphragm when the voice coil slides on the first end of the pole piece in response to the electromotive force.

3. A motor structure according to claim 2, wherein:

the second end of the pole piece comprises a base having a diameter larger than diameter of the first end of the pole piece;

the magnetic structure further comprises:

an upper back plate comprising a first and second upper back plate surfaces normal to the axis, and portions defining an upper back plate opening between the first and second upper back plate surfaces, the upper back plate opening having a first dimension near the first upper back plate surface and a second dimension near the second upper back plate surface, the first dimension being smaller than the second dimension, the first dimension being smaller than the diameter of the base; and a lower back plate comprising a first lower back plate surface and a second lower back plate surface opposite the first lower back plate surface, the first lower back plate surface being attached by to the second upper back plate surface to form a chamber defined by the first lower back plate surface and the portions of the upper back plate that define the opening near the second upper back plate surface;

wherein the base of the pole piece is positioned in the chamber so that the pole piece is capable of being rotated around the axis when the lower back plate is loosely attached to the upper back plate.

4. A motor structure according to claim 3, wherein:

the first end of the pole piece is substantially cylindrical having a periphery, the first end of the pole piece comprising portions defining at least one pole piece irregularity on the periphery; and the opening of the magnetic structure proximate to the first end of the pole piece is substantially round with at least one magnetic structure irregularity.

5. A motor structure according to claim 4, wherein the pole piece further comprises portions defining a center bore extending from the first end to the second end, and the lower back plate further comprises portions defining a center opening extending from the first lower back plate surface to the second lower back plate surface, whereby air flows through the center bore of the pole piece and the center opening of the lower back plate.

6. A motor structure according to claim 5, further comprising bolts attaching the lower back plate to the upper back plate.

7. A motor structure according to claim 4, wherein:

the at least one pole piece irregularity comprises a plurality of pole piece irregularities evenly spaced on the periphery; and the at least one magnetic structure irregularity comprises a plurality of magnetic structure irregularities evenly spaced on the portions defining the opening of the magnetic structure proximate the first end of the pole piece.

8. A motor structure according to claim 7, wherein the pole piece further comprises portions defining a center bore from the first end to the second end, and the lower back plate further comprises portions defining a center opening from the first lower back plate surface to the second lower back plate surface, whereby air flows through the center bore of the pole piece and the center opening of the lower back plate.

9. A loudspeaker motor structure comprising:

a pole piece comprising a top end and a base, the top end comprising cylindrical walls elongated along a center line axis, the walls comprising at least one pole piece irregularity, the base having a base diameter larger than diameter of the top end;

a magnet comprising first and second magnet surfaces normal to the axis, and portions defining a magnet opening extending along the axis;

a front plate comprising first and second front plate surfaces normal to the axis, and portions defining a front plate opening with at least one front plate irregularity, the second front plate surface being attached to the first magnet surface;

an upper back plate comprising first and second upper back plate surfaces normal to the axis, and portions defining an upper back plate opening extending along the axis between the first and second upper back plate surfaces, the upper back plate opening comprising a first space with a first dimension near the first upper back plate surface and a second space with a second dimension near the second upper back plate surface, the first dimension being smaller than the second dimension, the first dimension being smaller than the base diameter, the first upper back plate surface being attached to the second magnet surface;

a lower back plate attached to the second upper back plate surface; and a voice coil sliding on the top end of the pole piece;

wherein the base is positioned in the second space, the top end is positioned in the front plate opening to form a gap between the top end and the front plate, magnetic field extending through the gap, the lower and upper back plates are capable of loose and tight attachment, the pole piece being capable of rotation around the axis relative to the front plate to change strength of the magnetic field when the upper and lower back plates are loosely attached to each other.

10. A motor structure according to claim 9, further comprising a diaphragm and a spider, wherein:

the voice coil comprises a former and wire windings capable of receiving driving current, the voice coil being subjected to an electromotive force generated by interaction of the driving current and the magnetic field in the gap;

the former of the voice coil is coupled to the spider; and the former of the voice coil is coupled to the diaphragm to move the diaphragm when the voice coil slides on the top end of the pole piece in response to the electromotive force.

11. A motor structure according to claim 10, further comprising bolts attaching the lower back plate to the upper back plate.

12. A motor structure according to claim 11, wherein:

the pole piece further comprises portions defining a center bore from the top end to the base; and the lower back plate further comprises first and second lower back plate surfaces normal to the axis, and portions defining a lower back plate opening between the first and second lower back plate surfaces;

whereby air flows through the center bore and the lower back plate opening.

13. A motor structure according to claim 12, wherein:

the at least one pole piece irregularity comprises a plurality of evenly spaced pole piece irregularities; and the at least one front plate irregularity comprises a plurality of evenly spaced front plate irregularities.

14. A motor structure according to claim 13, wherein:

the plurality of pole piece irregularities comprises a plurality of slots; and the plurality of front plate irregularities comprises a plurality of notches.

15. A loudspeaker comprising:

a basket;

a diaphragm;

a spider attached to the basket;

a pole piece comprising a top end and a base, the top end comprising cylindrical walls elongated along a center line axis, the walls comprising at least one pole piece irregularity, the base having a base diameter larger than diameter of the top end;

an annular magnet comprising first and second magnet surfaces normal to the axis, and portions defining a magnet opening extending along the axis;

a front plate attached to the basket, the front plate comprising first and second front plate surfaces normal to the axis, and portions defining a front plate opening with at least one front plate irregularity, the second front plate surface being attached to the first magnet surface;

an upper back plate comprising first and second upper back plate surfaces normal to the axis, and portions defining an upper back plate opening extending along the axis between the first and second upper back plate surfaces, the upper back plate opening comprising a first space with a first diameter near the first upper back plate surface and a second space with a second dimension near the second upper back plate surface, the first dimension being smaller than the second dimension, the first dimension being smaller than the base diameter, the first upper back plate surface being attached to the second magnet surface;

a lower back plate attached to the second upper back plate surface; and a voice coil comprising a former and wire windings capable of receiving driving current, the former being attached to the spider and to the diaphragm;

wherein:

the base is positioned in the second space, the top end is positioned in the front plate opening to form a gap between the top end and the front plate, magnetic field extends through the gap, the lower and upper back plates are capable of loose and tight attachment, the pole piece is capable of rotation around the axis relative to the front plate to change strength of the magnetic field when the upper and lower back plates are loosely attached to each other; and the voice coil slides on the top end to drive the diaphragm under influence of an electromotive force resulting from interaction of the magnetic field and the driving current.

16. A loudspeaker according to claim 15, wherein:

the at east one pole piece irregularity comprises a plurality of evenly spaced pole piece irregularities; and the at least one front plate irregularity comprises a plurality of evenly spaced front plate irregularities.

17. A loudspeaker motor structure comprising:

a magnetic pole piece comprising a bottom end and a top end elongated along an axis;

a magnetic structure comprising:

a magnet comprising a first magnetic pole and a second magnetic pole, and portions defining a first opening extending along the axis, the first end being positioned in the first opening to form a first gap between the first end and the portions defining the first opening, the portions defining the first opening being magnetically coupled to the first magnetic pole;

a magnetic back plate comprising threaded portions defining a second opening concentric with the axis, the back plate being magnetically coupled to the second magnetic pole;

a non-magnetic center thread component attached to the second end, the center thread component having a threaded jutting part positioned in the second opening and engaging the threaded portions so that rotation of the center thread component relative to the back plate moves the center thread component and the pole piece along the axis in relation to the back plate, varying a second gap between the back plate and the pole piece, thereby varying magnetic coupling between the pole piece and the back plate, and thereby varying magnetic field in the first gap; and a voice coil comprising a former and wire windings capable of receiving electric current, the voice coil sliding on the top end under influence of an electromotive force generated by interaction of the magnetic field in the first gap and the electric current.

18. A motor structure according to claim 17, further comprising at least one locknut positioned on the threaded jutting part of the center thread component to prevent the center thread component from rotating relative to the back plate when the at least one locknut is tightened against the back plate.

19. A motor structure according to claim 18, further comprising a heat-conducting non-magnetic sleeve having a base and a side wall surrounding a sleeve center opening, the side wall being positioned to receive the pole piece and allow the pole piece to slide along the axis inside the side wall substantially in contact with the pole piece, the base of the sleeve being attached to the back plate, whereby the sleeve facilitates heat transfer between the pole piece and the back plate.

20. A loudspeaker motor structure according to claim 19, further comprising a diaphragm and a spider, wherein:

the former of the voice coil is coupled to the spider; and the former of the voice coil is coupled to the diaphragm to move the diaphragm when the voice coil slides on the first end of the pole piece in response to the electromotive force.

21. A loudspeaker motor structure comprising:

a magnetic pole piece comprising a cylindrical top end elongated along a center line axis, and a bottom end comprising portions defining an aperture extending along the axis;

a magnet comprising first and second magnet surfaces normal to the axis;

a magnetic front plate comprising first and second front plate surfaces normal to the axis, and portions defining a front plate opening between the first and second front plate surfaces, the second front plate surface being attached to the first magnet surface;

a magnetic back plate comprising first and second back plate surfaces normal to the axis, and portions defining a back plate opening between the first and second back plate surfaces, the portions defining the back plate opening comprising portions defining a first space with a first dimension near the first back plate surface and threaded portions defining a second space with a second diameter near the second back plate surface;

a non-magnetic center thread component comprising an inner part positioned in the aperture and a jutting part protruding from the aperture, the jutting part being threaded into the second space so that the top end is positioned in the front plate opening to form a gap between the pole piece and the front plate; and a voice coil sliding on the top end;

wherein magnetic field extends through the gap, strength of the magnetic field increases when the pole piece is turned in a first direction to bring the pole piece towards the back plate, the strength of the magnetic field decreases when the pole piece is turned in a second direction to take the pole piece away from the back plate.

22. A motor structure according to claim 21, wherein the first dimension is larger than the second dimension, the motor structure further comprising a heat-conducting non-magnetic sleeve having a base and a side wall surrounding a sleeve center opening, the side wall being capable of receiving the pole piece and allowing the pole piece to slide inside the side wall substantially in contact with the pole piece, the base of the sleeve being attached to the back plate, whereby the sleeve facilitates heat transfer between the pole piece and the back plate.

23. A motor structure according to claim 22, wherein the side wall is cylindrical having an outside diameter substantially equal to outside diameter of the top end of the pole piece, and an inside diameter substantially equal to a diameter of the bottom end.

24. A motor structure according to claim 23, further comprising a diaphragm and a spider, wherein:

the voice coil comprises a former and wire windings capable of receiving driving current, the voice coil being subjected to an electromotive force generated by interaction of the driving current and the magnetic field in the gap;

the former of the voice coil is coupled to the spider; and the former of the voice coil is coupled to the diaphragm to move the diaphragm when the voice coil slides on the top end of the pole piece in response to the electromotive force.

25. A motor structure according to claim 24, wherein:

the pole piece further comprises portions defining a first through bore from the top end to the aperture; and the center thread component further comprises portions defining a second through bore extending along the axis;

whereby air flows through the first and second through bores.

26. A motor structure according to claim 21, further comprising at least one locknut positioned on the jutting part of the center thread component to prevent the center thread component from rotating relative to the back plate when the at least one locknut is tightened against the back plate.

27. A loudspeaker comprising:

a basket;

a diaphragm;

a spider attached to the basket;

a magnetic pole piece comprising a cylindrical top end elongated along a center line axis, and a bottom end comprising portions defining an aperture extending along the axis;

a magnet comprising first and second magnet surfaces normal to the axis;

a magnetic front plate attached to the frame, the front plate comprising first and second front plate surfaces normal to the axis, and portions defining a front plate opening between the first and second front plate surfaces, the second front plate surface being attached to the first magnet surface;

a magnetic back plate comprising first and second back plate surfaces normal to the axis, and portions defining a back plate opening between the first and second back plate surfaces, the portions defining the back plate opening comprising portions defining a first space with a first dimension near the first back plate surface and threaded portions defining a second space with a second diameter near the second back plate surface;

a non-magnetic center thread component comprising an inner part positioned in the aperture and a jutting part protruding from the aperture, the jutting part being threaded into the second space so that the top end is positioned in the front plate opening to form a gap between the pole piece and the front plate; and a voice coil sliding on the top end, the voice coil comprising a former attached to the spider and to the diaphragm, the voice coil further comprising wire windings capable of receiving driving current;

wherein:

magnetic field extends through the gap, strength of the magnetic field increases when the pole piece is turned in a first direction to bring the pole piece towards the back plate, the strength of the magnetic field decreases when the pole piece is turned in a second direction to take the pole piece away from the back plate; and the voice coil is positioned in the gap and moved by an electromotive force generated by interaction of the driving current and the magnetic field in the gap.

28. A loudspeaker motor structure comprising:

a magnetic pole piece comprising a first end and a second end;

a magnetic structure comprising:

a magnet with a first and second magnetic poles, means for magnetically coupling the second magnetic pole to the second end of the pole piece, and portions defining an opening, the first end of the pole piece being disposed in the opening to form a gap between the first end and the portions defining the opening, the portions defining the opening being magnetically coupled to the first magnetic pole, thereby creating a magnetic field in the gap;

means for moving the pole piece to adjust strength of the magnetic field in the gap; and a voice coil sliding on the first end, the voice coil comprising a former and wire windings capable of receiving driving current, the voice coil being influenced by an electromotive force generated by interaction of the driving current and the magnetic field in the gap.

* * * * *